US011419410B1

(12) United States Patent
Tang et al.

(10) Patent No.: US 11,419,410 B1
(45) Date of Patent: Aug. 23, 2022

(54) LIFTING TABLE

(71) Applicant: Shanghai Tengfei Communication Equipment Industry Co., Ltd, Shanghai (CN)

(72) Inventors: Yongfei Tang, Shanghai (CN); Wenmin Pan, Shanghai (CN)

(73) Assignee: SHANGHAI TENGFEI COMMUNICATION EQUIPMENT INDUSTRY CO., LTD, Shanghai (CN)

( * ) Notice: Subject to any disclaimer, the term of this patent is extended or adjusted under 35 U.S.C. 154(b) by 0 days.

(21) Appl. No.: 17/168,880

(22) Filed: Feb. 5, 2021

(51) Int. Cl.
*A47B 9/12* (2006.01)
*A47B 9/20* (2006.01)

(52) U.S. Cl.
CPC ..... *A47B 9/12* (2013.01); *A47B 9/20* (2013.01); *A47B 2200/0054* (2013.01); *A47B 2200/0057* (2013.01)

(58) Field of Classification Search
CPC ..... A47B 9/12; A47B 9/20; A47B 2200/0054; A47B 2200/0057
USPC ..... 108/147; 248/188.2, 188.3, 188.5
See application file for complete search history.

(56) References Cited

U.S. PATENT DOCUMENTS 4,351,245 A * 9/1982 Laporte ..... A47B 27/06 108/136
4,619,208 A * 10/1986 Kurrasch ..... A47B 9/12 108/106
5,400,721 A * 3/1995 Greene ..... A47B 9/02 108/147
5,598,789 A * 2/1997 Jonker ..... A47B 9/12 108/147
5,682,825 A * 11/1997 Manner ..... A47B 9/02 108/147
6,152,049 A * 11/2000 Schmidt ..... A47B 9/12 108/147
8,256,358 B2 * 9/2012 Looser ..... A47B 27/02 108/147
9,038,549 B1 * 5/2015 Zebarjad ..... A47B 9/02 108/147
2001/0037751 A1 * 11/2001 Agee ..... A47B 9/12 108/147
2004/0166977 A1 * 8/2004 Nielsen ..... A47B 9/20 474/148
2008/0178779 A1 * 7/2008 Agee ..... A47B 9/04 108/147

(Continued)

*Primary Examiner* — Jose V Chen

(57) ABSTRACT

A lifting table that includes a worksurface, a left table leg assembly, a right table leg assembly, a left table feet assembly, and a right table feet assembly, and a beam assembly. The right table leg assembly. The left table leg assembly and the right table leg assembly vertically support the worksurface. The left table feet assembly is connected with the left table leg assembly. The right table feet assembly is connected with the right table leg assembly. The beam assembly is horizontally connected with the left table leg assembly and the right table leg assembly. The beam assembly includes a plurality of beam components such as a spool assembly and a drive spring. The spool assembly includes an aluminium bracket, a spool, a brake gear, and a gear shaper assembly. The drive spring is connected to the spool through a spool drive rope to power the lifting table. The spool is wound with an active wire rope and an auxiliary wire rope, coiled in opposite directions.

20 Claims, 21 Drawing Sheets

(56) References Cited

U.S. PATENT DOCUMENTS

| | | | | |
|---|---|---|---|---|
| 2015/0136000 | A1* | 5/2015 | Holtschi | A47B 9/20 108/146 |
| 2015/0320198 | A1* | 11/2015 | Zebarjad | A47B 9/20 108/147 |
| 2016/0088930 | A1* | 3/2016 | Hansen | F16F 9/0245 108/147 |
| 2016/0227921 | A1* | 8/2016 | Hansen | A47B 9/02 |
| 2018/0090915 | A1* | 3/2018 | Byrne | H02B 1/06 |
| 2018/0092457 | A1* | 4/2018 | Lai | A47B 9/12 |
| 2020/0093259 | A1* | 3/2020 | Verhappen | A47B 9/14 |
| 2020/0121072 | A1* | 4/2020 | Tao | A47B 9/12 |
| 2020/0163451 | A1* | 5/2020 | Tao | A47B 9/10 |
| 2020/0329862 | A1* | 10/2020 | Tao | A47B 9/12 |
| 2020/0337451 | A1* | 10/2020 | Tao | F16F 9/0281 |
| 2021/0100355 | A1* | 4/2021 | Jorgensen | A47B 3/0809 |
| 2021/0259403 | A1* | 8/2021 | Swetharanyam | A47B 21/02 |

* cited by examiner

LIFTING TABLE

BACKGROUND

Technical Field

The inventive subject matter presented herein is generally directed towards a lifting table. More particularly embodiments are related to, but not limited to, the lifting table which is manually adjusted by a user.

Description of the Related Art

Currently, a formal office set up includes a fixed-height desk, a staff seated office, and a relatively fixed posture, which usually causes symptoms such as backache, shoulder and neck discomfort, and can also cause serious health problems. At present, the height-adjustable lifting tables on the market are generally mainly electric, and their requirements for electricity make the application relatively limited.

Many mechanisms exist to manually lift the tables. Some lifting tables include legs that have adjustment mechanisms so that the length of the leg, and height of the table above the floor can be adjusted. Further, the more common one is to use the handle to rotate, and the screw structure is relatively rotated through the transmission device to produce relative displacement, thereby changing the height of the tabletop and adjusting it. It is cost-saving but the adjustment speed is slow. The mechanism needs to be maintained more frequently, and it takes more physical effort to lift the tabletop. Also, the angle of the corresponding structure can be changed through the latch and the rotating mechanism to change the height of the tabletop, but it is more inconvenient and dangerous. The adjustment speed is slow and generally, only discrete gears can be set. There is also direct use of preset jacks and pins to cooperate to change the height of the desktop, although the structure is simple, there are only a limited number of discrete gears. It is available, and the operation is dangerous, and there are certain requirements for the user's physical strength.

Accordingly, a need remains for a lifting table with a self-locking mechanism to solve the aforementioned issues and provide a continuous adjustment of the height of various computing devices such as a desktop, computer, or a laptop.

Thus, in view of the above, there is a long-felt need to address the described issues.

Further limitations and disadvantages of conventional and traditional approaches will become apparent to one of ordinary skill in the art through comparison of described systems with some aspects of the present disclosure, as set forth in the remainder of the present application and with reference to the drawings.

SUMMARY

A lifting table is provided and shown in and/or described in connection with the figures.

One aspect of the inventive subject matter relates to a lifting table that includes a worksurface, a left table leg assembly, a right table leg assembly, a left table feet assembly, and a right table feet assembly, and a beam assembly. The left table leg assembly and the right table leg assembly vertically support the worksurface. The left table feet assembly is connected with the left table leg assembly. The right table feet assembly is connected with the right table leg assembly. The beam assembly is horizontally connected with the left table leg assembly and the right table leg assembly. The beam assembly includes a plurality of beam components such as a spool assembly and a drive spring. The spool assembly includes an aluminium bracket, a spool, a brake gear, and a gear shaper assembly. The drive spring is connected to the spool through a spool drive rope to power the lifting table. The spool is wound with an active wire rope and an auxiliary wire rope, coiled in opposite directions.

In an embodiment, the left table leg assembly comprising a left inner tube, a left middle tube, and a left outer tube.

In an embodiment, the right table leg assembly comprising a right inner tube, a right middle tube, and a right outer tube.

In an embodiment, the left middle tube comprising a left roller frame, and a left roller.

In an embodiment, the right middle tube comprising a right roller frame, and a right roller.

In an embodiment, the gear shaper assembly includes a gear shaper, a gear shaper seat, a brake rope, and a compression spring.

In an embodiment, the brake rope is tightened to enable a toothing to separate from the brake gear and allow the user to rotate the spool and lift the lifting table.

In an embodiment, the spring tension regulator comprising a gear box, a plurality of bevel gears, an adjusting screw, and an adjusting shaft.

In an embodiment, the active wire rope and the auxiliary wire rope are respectively connected to at least two-wire ropes in the left table leg assembly and the right table leg assembly.

In an embodiment, the beam components include a spring tension regulator adjusted based on a load force applied on the lifting table.

In an embodiment, the drive spring is stretched and the spool rotates counterclockwise to drive the active wire rope to move downwards and the auxiliary wire rope to move upwards upon pressing down the lifting table.

In an embodiment, when the lifting table is raised, the drive spring retracts, and the spool is clockwise illusory, driving the active wire rope upward and the auxiliary wire rope downward.

In an embodiment, the left inner tube, the left outer tube, the right inner tube, and the right outer tube are made of high-quality cold-drawn square tubes with a smooth surface and high dimensional accuracy.

Accordingly, one advantage of the present inventive subject matter is that the operation process of the lifting table saves time and effort for the user.

Accordingly, one advantage of the present inventive subject matter is that it facilitates the users to set the brake to realize the on-demand follow-up stop. This lifting table can be utilized in various premises such as office, home.

Accordingly, one advantage of the present inventive subject matter is that the rollers of the inner and outer tubes and the middle tube slide in cooperation, with smooth sliding, low resistance, low noise, and long service life.

Accordingly, one advantage of the present inventive subject matter is that the spring tension regulator adopts the lower modulus bevel gear to rotate, which has low cost and stable rotation.

Accordingly, one advantage of the present inventive subject matter is that it adopts the cooperation of brake gear and tooth shaper to realize arbitrary positioning of the lifting table, with simple structure, low cost, and large locking force.

Accordingly, one advantage of the present inventive subject matter is that it utilizes transmission wire rope that adopts high-strength galvanized steel wire rope, with a U-groove roller, with low transmission noise, stable operation, low wear, and long service life.

These features and advantages of the present disclosure may be appreciated by reviewing the following description of the present disclosure, along with the accompanying figures wherein like reference numerals refer to like parts.

BRIEF DESCRIPTION OF THE DRAWINGS

The accompanying drawings illustrate the embodiments of systems, methods, and other aspects of the disclosure. A person with ordinary skills in the art will appreciate that the illustrated element boundaries (e.g., boxes, groups of boxes, or other shapes) in the figures represent an example of the boundaries of such elements. In some examples, one element may be designed as multiple elements, or multiple elements may be designed as one element. In some examples, an element shown as an internal component of one element may be implemented as an external component in another and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DETAILED DESCRIPTION

The present disclosure is best understood with reference to the detailed figures and description set forth herein. Various embodiments of the present systems and methods have been discussed with reference to the figures. However, those skilled in the art will readily appreciate that the detailed description provided herein including the figures are presented for explanatory purposes and the embodiments extend beyond the currently described embodiments. For instance, the teachings and results presented in any particular described application may yield multiple alternative approaches and may be implemented in any suitable manner.

The described embodiments may be implemented manually, automatically, and/or a combination of thereof. The term "method" refers to manners, means, techniques, and procedures for accomplishing any task including, but not limited to, those manners, means, techniques, and procedures either known to the person skilled in the art or readily developed from existing manners, means, techniques and procedures by practitioners of the art to which the embodiments pertains. Persons skilled in the art will envision many other possible variations that are within the scope of the claimed subject matter.

Figure 1:
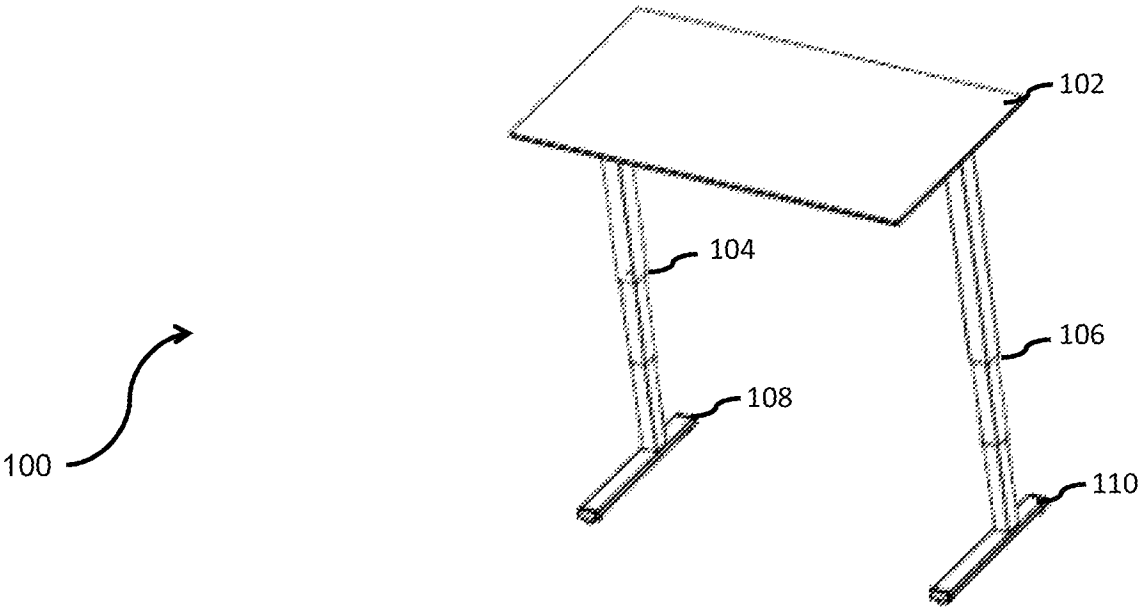
FIG. 1 illustrates a perspective view of a lifting table, in accordance with an embodiment of the present invention.
Figure 2:
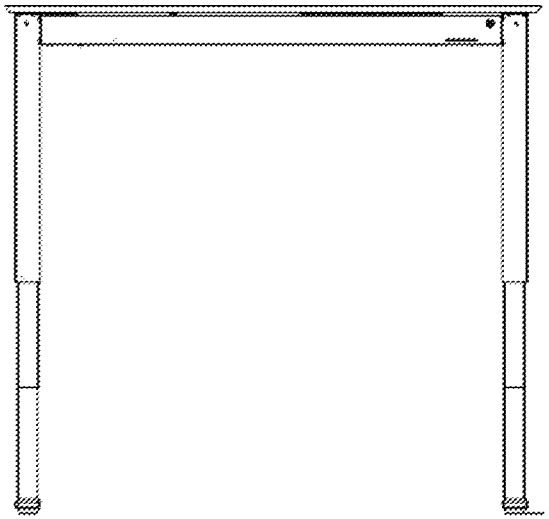
FIG. 2 illustrates a front view of the lifting table, in accordance with an embodiment of the present invention.

FIG. 1 illustrates a perspective view of a lifting table 100, in accordance with an embodiment of the present invention. FIG. 1 is explained in conjunction with FIG. 2. FIG. 2 illustrates a front view of the lifting table, in accordance with an embodiment of the present invention. The lifting table 100 provides a continuous adjustment of the height of various computing devices such as a desktop, computer, or a laptop. The lifting table 100 facilitates the users to set the brake to realize the on-demand follow-up stop. This lifting table can be utilized in various premises such as office, home.

Figure 3:
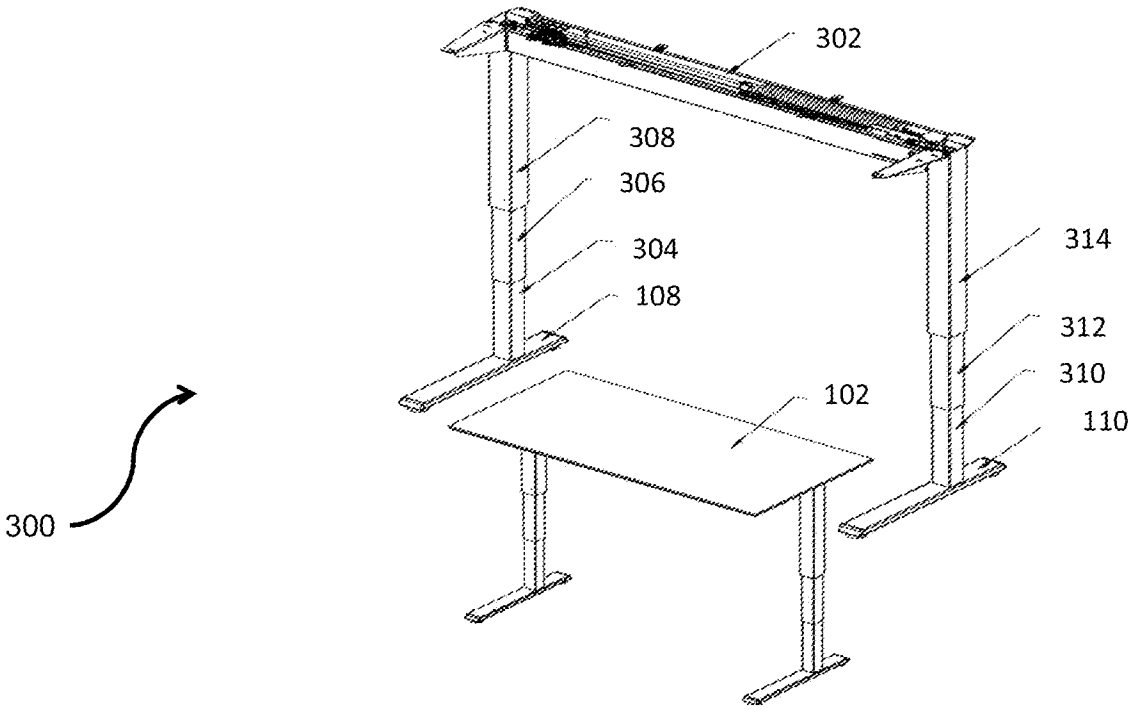
FIG. 3 illustrates an exploded view of the lifting table, in accordance with an embodiment of the present invention.

The lifting table 100 includes a worksurface 102, a left table leg assembly 104, a right table leg assembly 106, a left table feet assembly 108, and a right table feet assembly 110, and a beam assembly 302 (shown in FIG. 3). FIG. 3 illustrates an exploded view 300 of the lifting table, in accordance with an embodiment of the present invention. FIG. 3 is explained in conjunction with FIG. 1. The left table leg assembly 104 and the right table leg assembly 106 vertically support the worksurface 102. The left table feet assembly 108 is connected with the left table leg assembly 104. The right table feet assembly 110 is connected with the right table leg assembly 106. The beam assembly 302 is horizontally connected with the left table leg assembly 104 and the right table leg assembly 106. In an embodiment, the left table leg assembly 104 includes a left inner tube 304, a left middle tube 306, and a left outer tube 308. In an embodiment, the right table leg assembly 106 includes a right inner tube 310, a right middle tube 312, and a right outer tube 314. In an embodiment, the left inner tube 304, the left outer tube 308, the right inner tube 310, and the right outer tube 314 are made of high-quality cold-drawn square tubes with a smooth surface and high dimensional accuracy. In an embodiment, the left middle tube 306 is installed between the left inner tube 304 and the left outer tube 308, and the left outer tube 308 slides up and slide down through a left rolling of the left roller on the left middle tube 306 and the relative movement of the active wire rope and the auxiliary rope. In an embodiment, the right middle tube 312 is installed between the right inner tube 310 and the right outer tube 314, and the right outer tube 314 slides up and slide down through a right rolling of the right roller on the right middle tube 312 and the relative movement of the active wire rope and the auxiliary rope.

Figure 4:
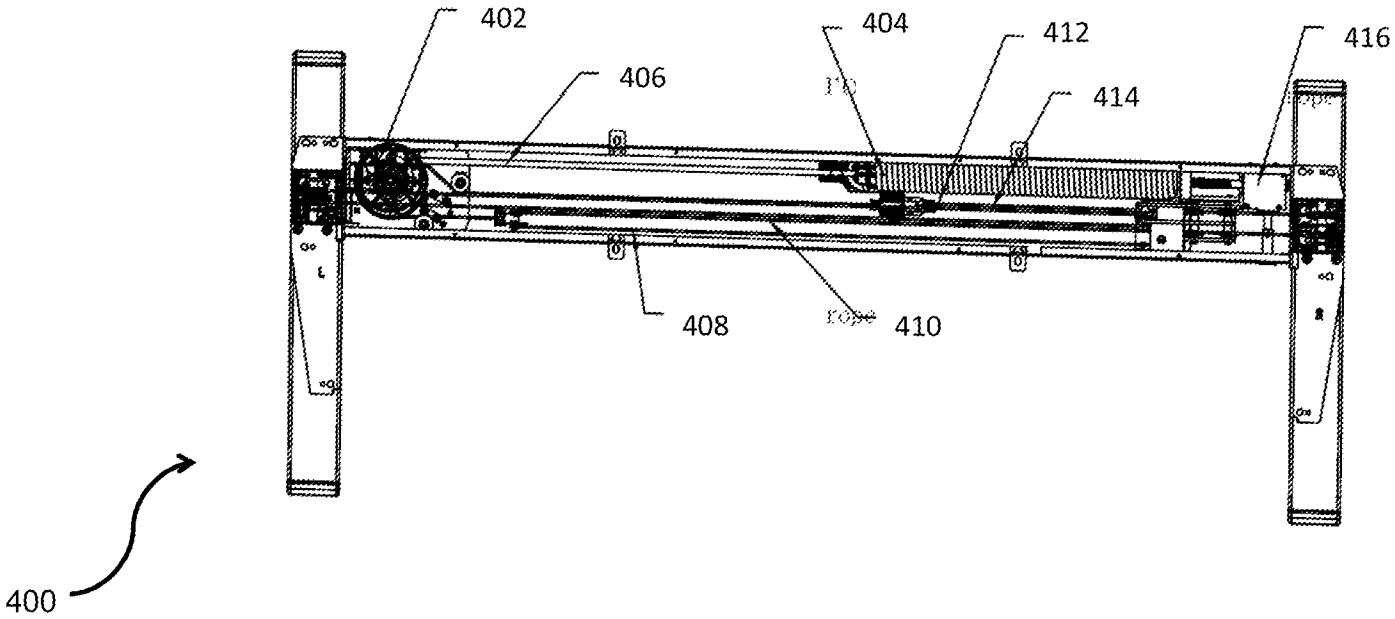
FIG. 4 illustrates a perspective view of a beam assembly, in accordance with an embodiment of the present invention.
Figure 9:
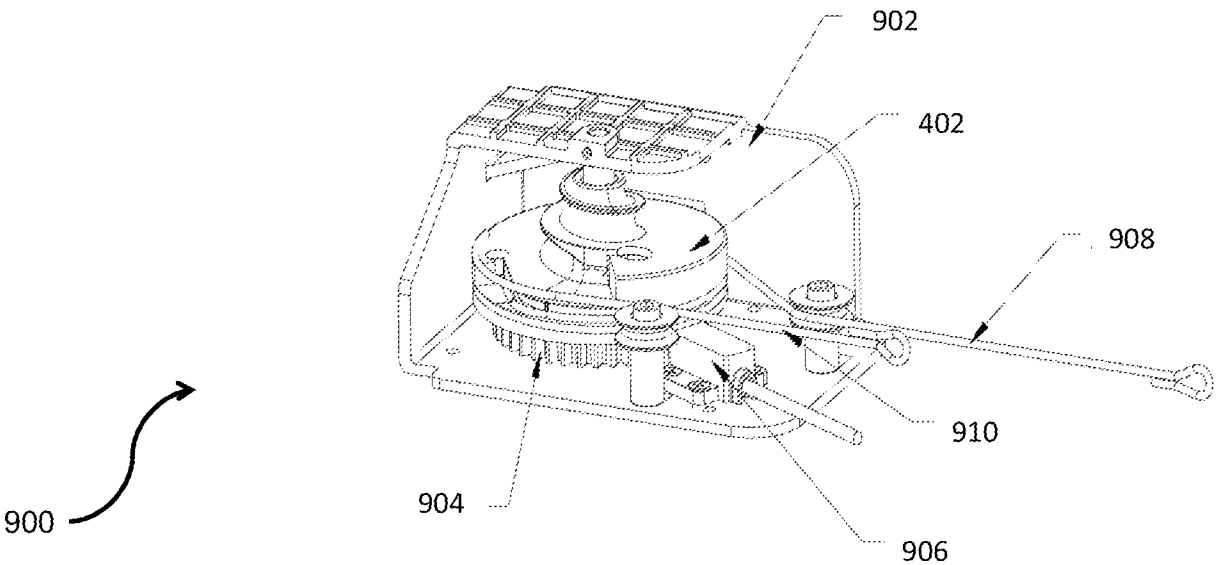
FIG. 9 illustrates a perspective view of a spool assembly, in accordance with an embodiment of the present invention.
Figure 12:
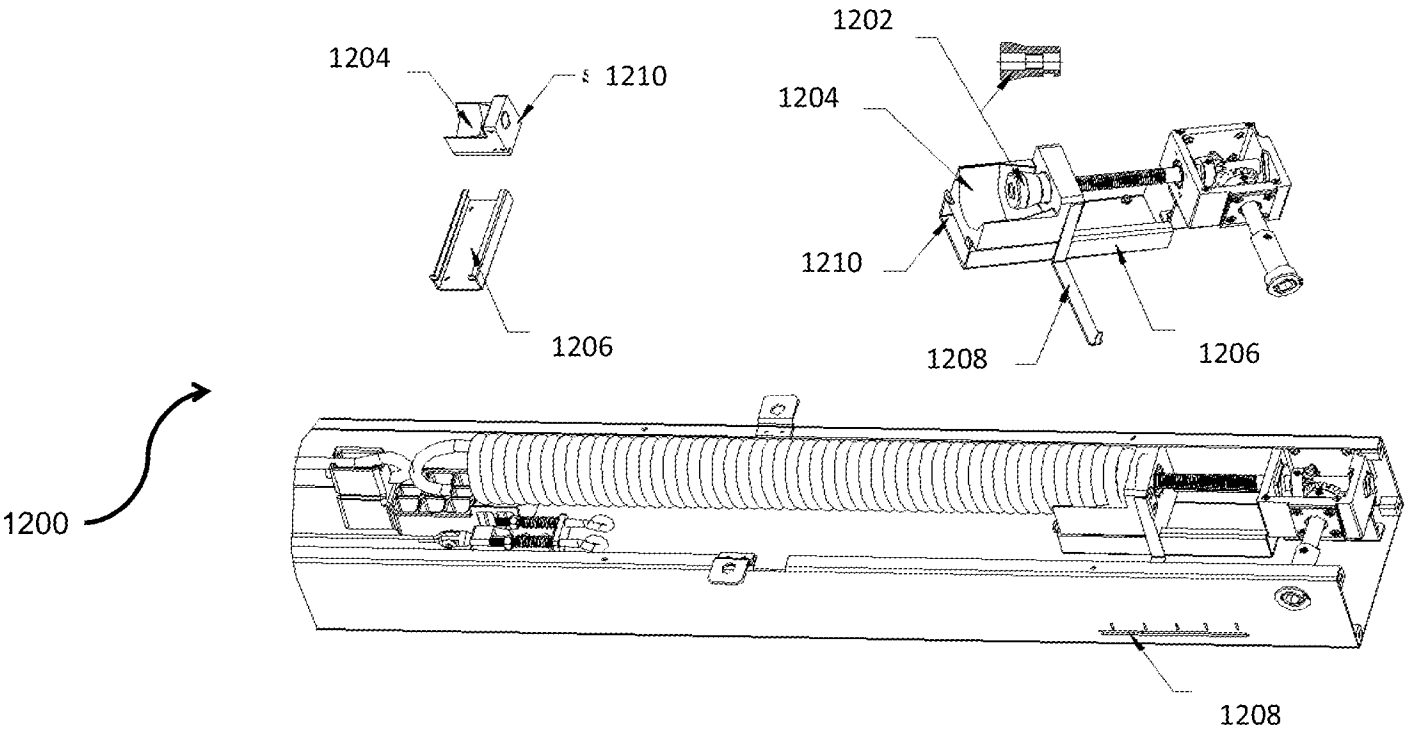
FIG. 12 illustrates a perspective view of the spring force adjustment mechanism, in accordance with an embodiment of the present invention.

FIG. 4 illustrates a perspective view 400 of a beam assembly, in accordance with an embodiment of the present invention. FIG. 4 is explained in conjunction with FIG. 3. The beam assembly 302 includes a plurality of beam components such as a spool assembly 900 (also shown in FIG. 9) and a drive spring 404. FIG. 9 illustrates a perspective view of the spool assembly 900, in accordance with an embodiment of the present invention. The spool assembly 900 includes an aluminum bracket 902, a spool 402, a brake gear 904, and a gear shaper assembly 906. According to an embodiment herein, the spool assembly 900 includes auxiliary wire rope 908 and active wire rope 910. The drive spring 404 is connected to the spool 402 through a spool drive rope 406 to power the lifting table. The spool 402 is wound with an active wire rope and an auxiliary wire rope, coiled in opposite directions. The active wire rope includes a left active rope 408 and a right active rope 410. The auxiliary wire rope includes a left auxiliary rope 412, and a right auxiliary rope 414. In an embodiment, the beam components include a spring tension regulator 416 is adjusted based on a load force applied on the lifting table to adjust the initial length of the spring. FIG. 12 illustrates a perspective view of spring force adjustment mechanism 1200, in accordance with an embodiment of the present invention. There is a spring head 1202 in the spring ends, the spring is placed on the spring seat 1204, the spring seat 1204 is clamped on the spring seat bottom plate 1206, the spring seat 1204 is fixed with a force value indicator 1208, and a slot 1210, and the spring seat 1204 bottom plate is fixed on the beam. The M10 screw of the tension regulator is connected with the internal thread of the spring end. When the spring force is increased, the adjusting shaft rotates clockwise, and the M10 screw drives the end of the spring to move to the right through the bevel gear transmission, so that the spring, the spring seat 1204, and the force value pointer are synchronized to the right. Decrease the spring force and move to the left instead. On the right part of the beam, there is a force pointer display window, and the spring force value can be adjusted according to the engraved line.

In an embodiment, the active wire rope and the auxiliary wire rope are respectively connected to at least two-wire ropes in the left table leg assembly and the right table leg assembly. When the lifting table is positioned, the brake line is in a loose state, and the tooth inserting enters the brake gear under the spool.

Figure 5A:
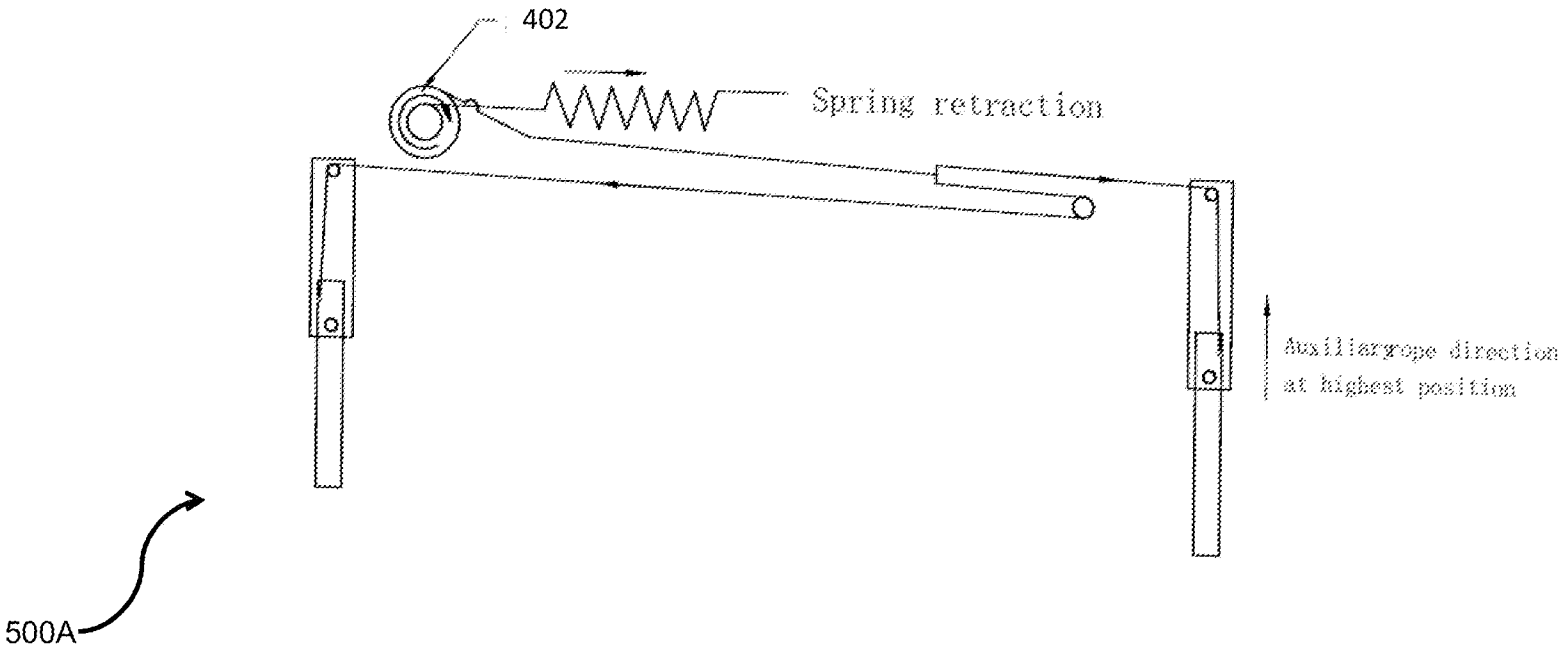
FIG. 5A illustrates a perspective view of an auxiliary wire rope direction at the highest position, in accordance with an embodiment of the present invention.
Figure 5B:
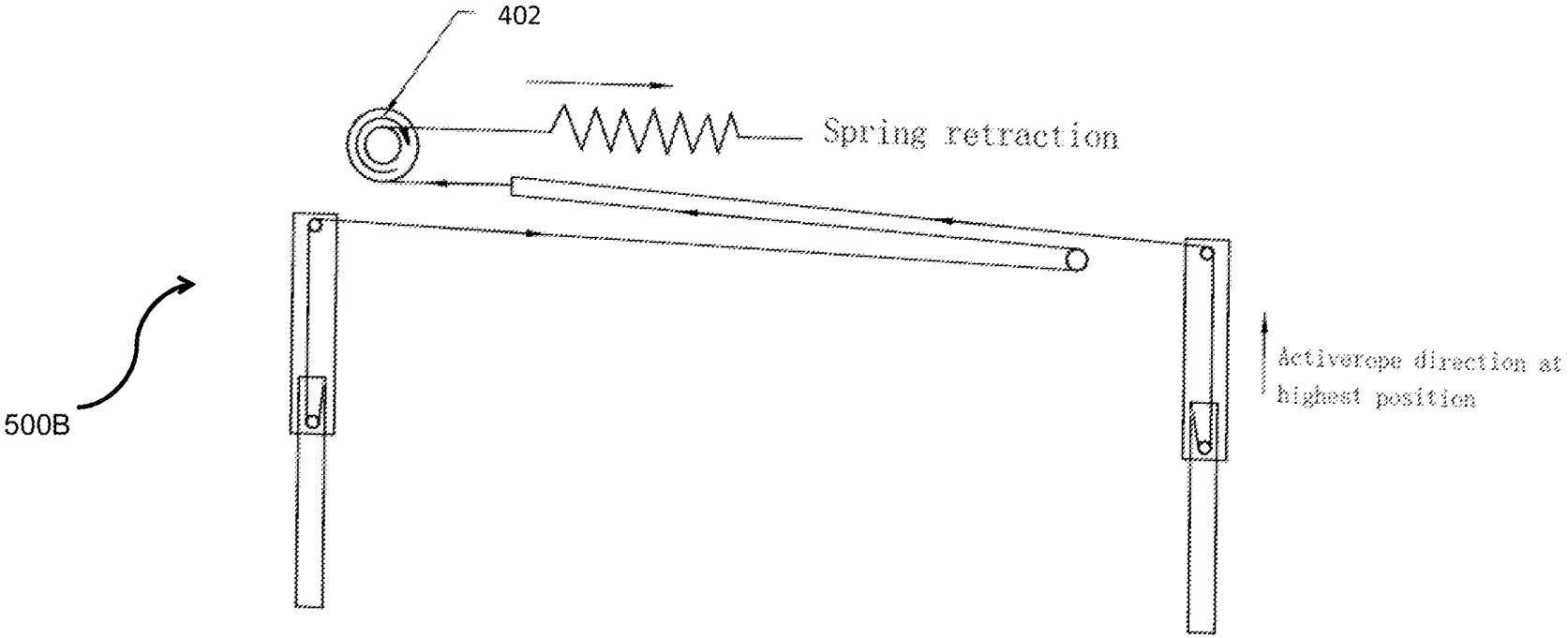
FIG. 5B illustrates a perspective view of an active wire rope direction at the highest position, in accordance with an embodiment of the present invention.
Figure 6A:
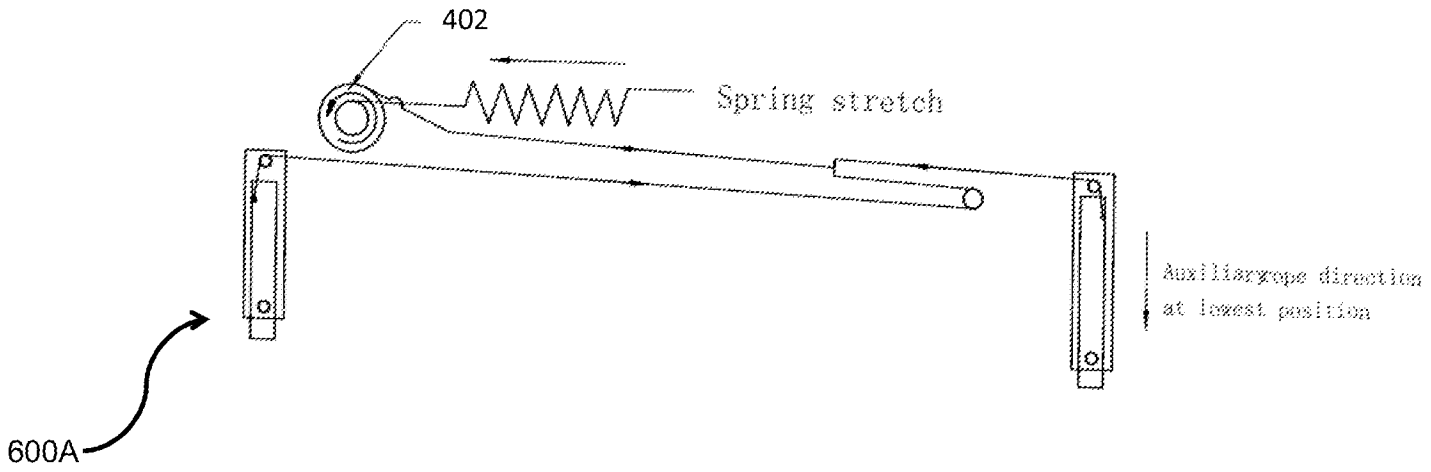
FIG. 6A illustrates a perspective view of an auxiliary wire rope direction at the lowest position, in accordance with an embodiment of the present invention.
Figure 6B:
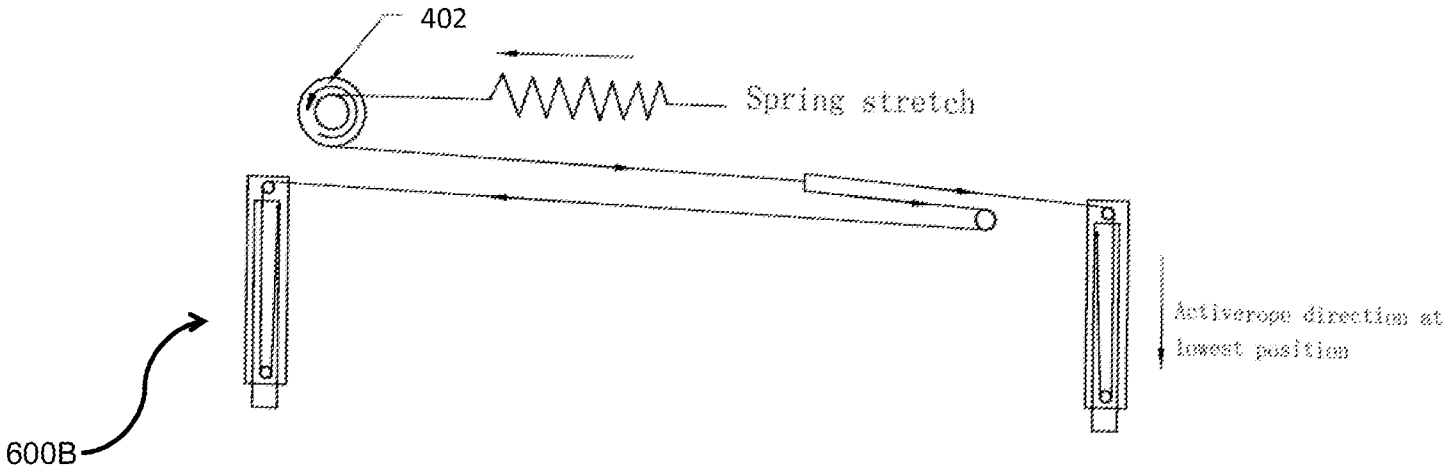
FIG. 6B illustrates a perspective view of an active wire rope direction at the lowest position, in accordance with an embodiment of the present invention.

FIG. 5A illustrates a perspective view 500A of an auxiliary wire rope direction at the highest position, in accordance with an embodiment of the present invention. In an embodiment, the drive spring 404 is stretched and the spool 402 rotates counterclockwise to drive the active wire rope to move downwards and the auxiliary wire rope to move upwards upon pressing down the lifting table. In an embodiment, when the lifting table is raised, the drive spring 404 retracts, and the spool 402 is clockwise illusory, driving the active wire rope upward and the auxiliary wire rope downward. FIG. 5B illustrates a perspective view 500B of an active wire rope direction at the highest position, in accordance with an embodiment of the present invention. According to an embodiment herein, when the lifting table is pressed down, the drive spring 404 is stretched and the spool 402 rotates counterclockwise to drive the active wire rope to move downwards and the auxiliary wire rope to move upwards. When the lifting table is raised, the drive spring 404 retracts, and the spool 402 is clockwise illusory, driving the active wire rope upward and the auxiliary wire rope downward. FIG. 6A illustrates a perspective view 600A of an auxiliary wire rope direction at the lowest position, in accordance with an embodiment of the present invention. FIG. 6B illustrates a perspective view 600B of an active wire rope direction at the lowest position, in accordance with an embodiment of the present invention.

Figure 7A:
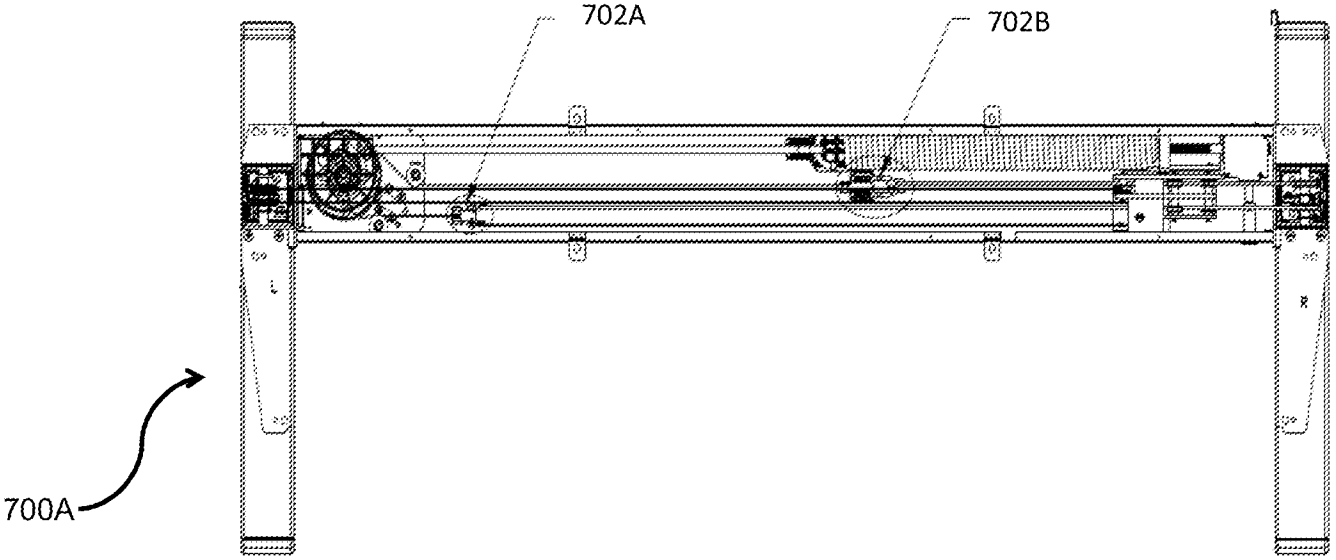
FIG. 7A illustrates a perspective view of the auxiliary wire rope and active wire rope direction position when the table at the highest position, in accordance with an embodiment of the present invention.
Figure 7B:
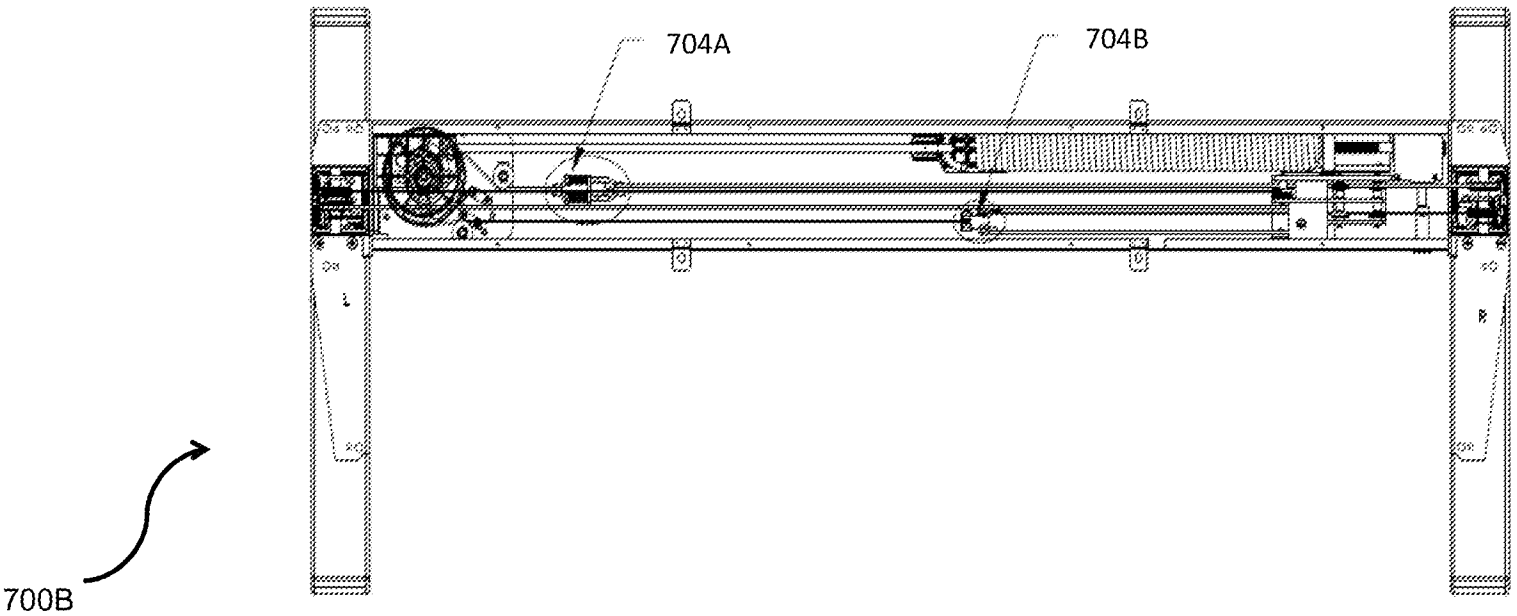
FIG. 7B illustrates a perspective view of the auxiliary wire rope and active wire rope direction position when the table at the lowest position, in accordance with an embodiment of the present invention.

FIG. 7A illustrates a perspective view 700A of the auxiliary wire rope and active wire rope direction position when the table at the highest position, in accordance with an embodiment of the present invention. FIG. 7A shows the active rope hook position 702A and auxiliary rope hook position 702B. FIG. 7B illustrates a perspective view 700B of the auxiliary wire rope and active wire rope direction position when the table at the lowest position, in accordance with an embodiment of the present invention. FIG. 7B shows the active rope hook position 704A and auxiliary rope hook position 704B.

Figure 8:
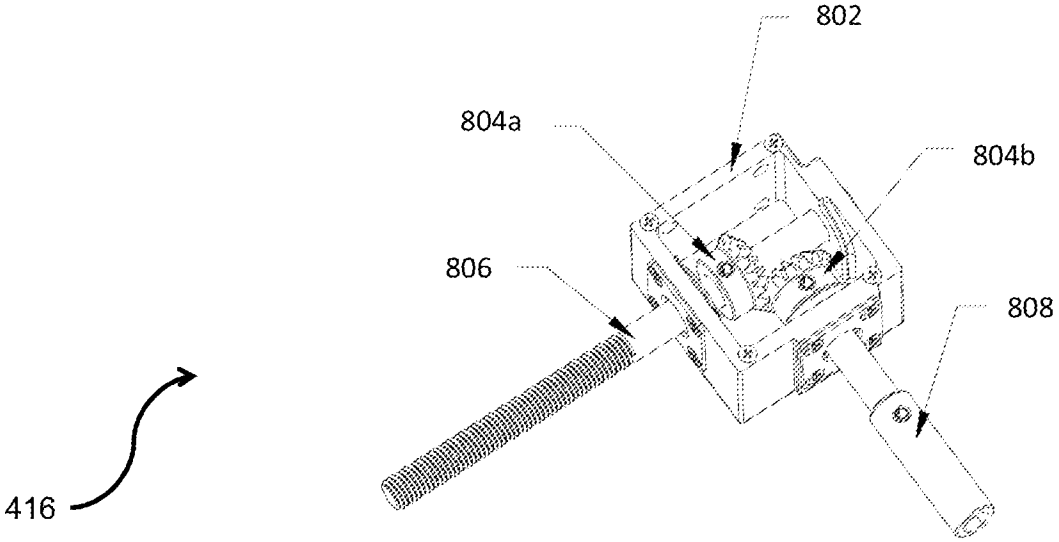
FIG. 8 illustrates a perspective view of a spring tension regulator, in accordance with an embodiment of the present invention.

FIG. 8 illustrates a perspective view of a spring tension regulator 416, in accordance with an embodiment of the present invention. In an embodiment, the spring tension regulator 416 includes a gear box 802, a plurality of bevel gears 804*a* and 804*b*, an adjusting screw 806, and an adjusting shaft 808. The adjusting screw 806 is connected with the spring end, and a tension value of the drive spring is adjusted.

Figure 10:
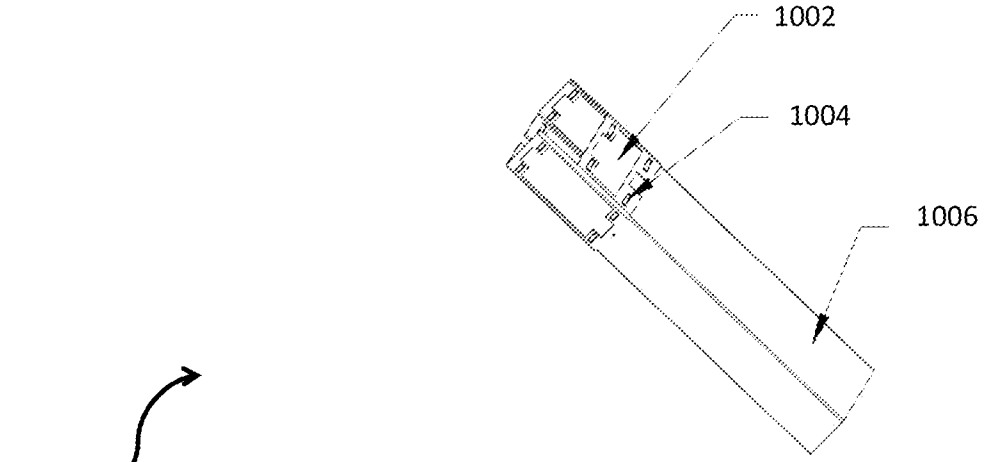
FIG. 10 illustrates a perspective view of a middle tube assembly, in accordance with an embodiment of the present invention.

FIG. 10 illustrates a perspective view of a middle tube assembly 1000, in accordance with an embodiment of the present invention. In an embodiment, the middle tube assembly 1000 is the left middle tube and right middle tube. The middle tube assembly 1000 includes a roller frame 1002, a roller 1004, and a middle tube 1006. The middle tube assembly 1000 is installed between the inner and outer tubes of the legs, and the outer tube slides up and down through the rolling of the roller on the middle tube and the relative movement of the active rope and the auxiliary rope. In an embodiment, the left middle tube includes a left roller frame and a left roller. In an embodiment, the right middle tube includes a right roller frame and a right roller.

Figure 11A:
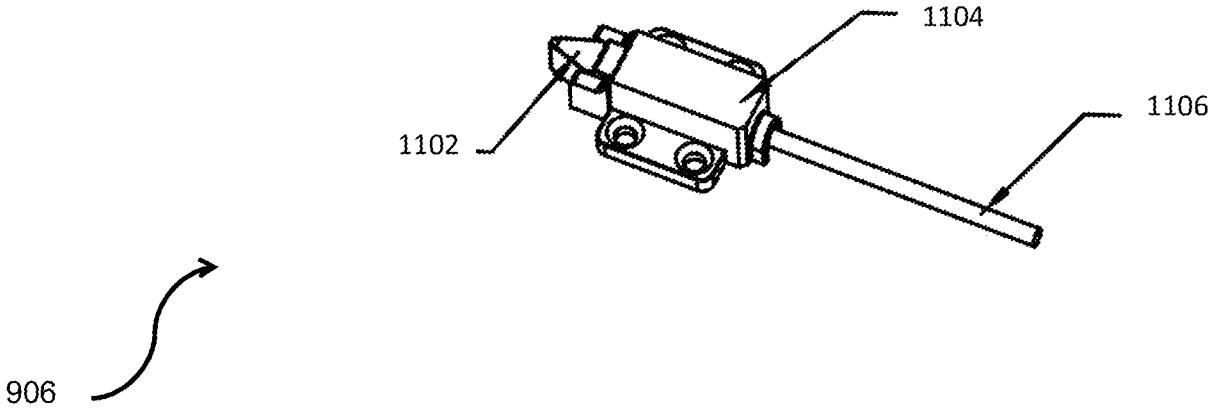
FIG. 11A illustrates a first perspective view of a gear shaper assembly, in accordance with an embodiment of the present invention.
Figure 11B:
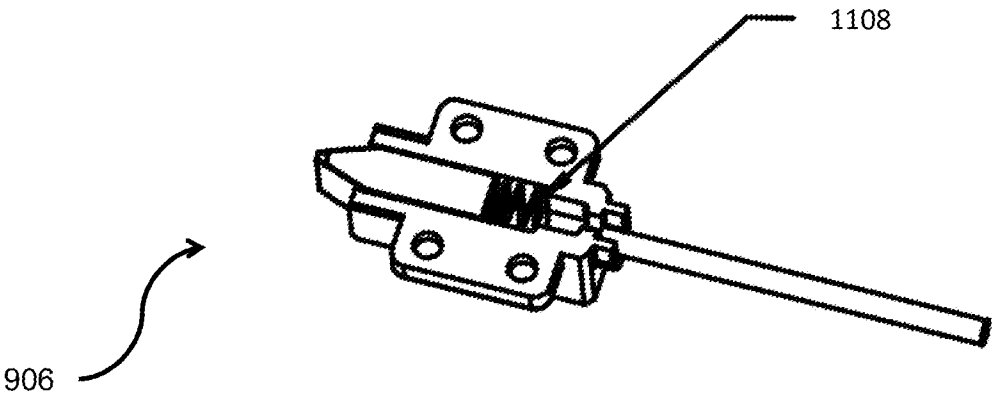
FIG. 11B illustrates a second perspective view of the gear shaper assembly, in accordance with an embodiment of the present invention.

FIG. 11A illustrates a first perspective view of a gear shaper assembly 906, in accordance with an embodiment of the present invention. FIG. 11B illustrates a second perspective view of the gear shaper assembly 906, in accordance with an embodiment of the present invention. The gear shaper assembly 906 includes a gear shaper 1102, a gear shaper seat 1104, a brake rope 1106, and a first compression spring 1108. In an embodiment, the brake rope 1106 is tightened to enable a toothing to separate from the brake gear 904 and allow the user to rotate the spool and lift the lifting table. The gear shaper assembly 906 includes a gear shaper 1102, a gear shaper seat 1104, a brake rope 1106, and a compression spring 1108.

Figure 11C:
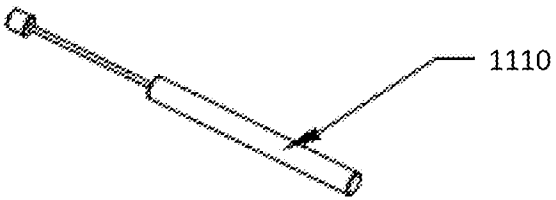
FIG. 11C illustrates a third perspective view of the gear shaper assembly, in accordance with an embodiment of the present invention.
Figure 11C:
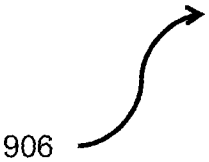
Figure 11D:
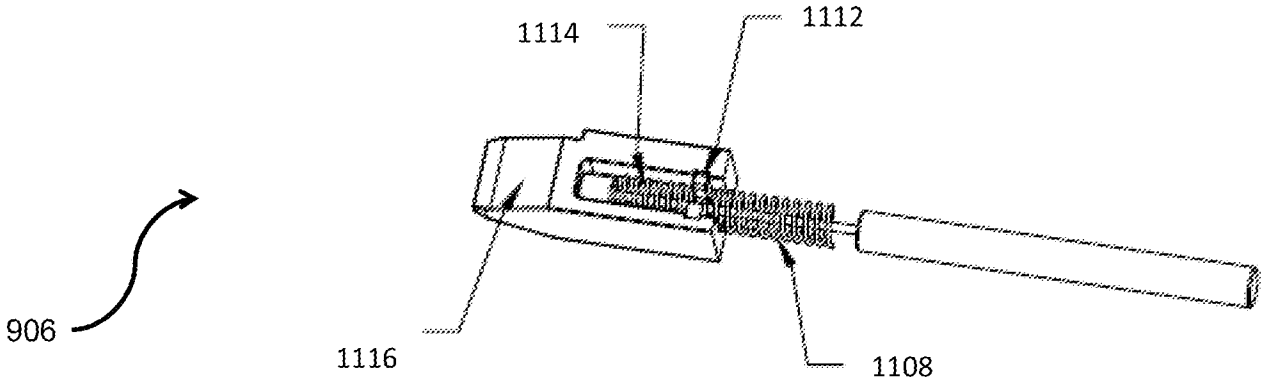
FIG. 11D illustrates a fourth perspective view of the gear shaper assembly, in accordance with an embodiment of the present invention.

FIG. 11C illustrates a third perspective view of the gear shaper assembly 906, in accordance with an embodiment of the present invention. In an embodiment, the gear shaper assembly 906 includes a brake rope 1110 and a slope surface 1116 (shown in FIG. 11D). FIG. 11D illustrates a fourth perspective view of the gear shaper assembly 906, in accordance with an embodiment of the present invention. The gear shaper 1102 is equipped with a baffle plate 1112. The first compression spring 1108. and a second compression spring 1114 are placed on both the sides of the baffle plate 1112, which are sleeved on the brake rope 1110.

Figure 11E:
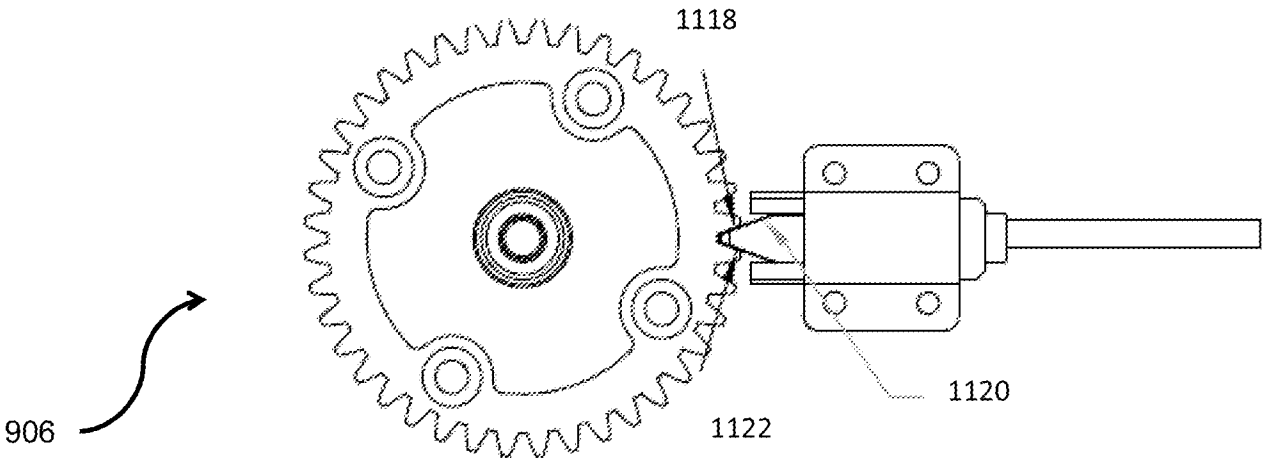
FIG. 11E illustrates a fifth perspective view of the gear shaper assembly, in accordance with an embodiment of the present invention.

FIG. 11E illustrates a fifth perspective view of the gear shaper assembly 906, in accordance with an embodiment of the present invention. When the lifting table is in position, due to the pulling force of the drive spring 404, the gear plate is forced clockwise, and the gear plate meshes with the toothing, generating an axial force F1 1118, and the gear is locked. When lifting the table, pull the brake wire, first pull the second compression spring 1114. If the spring tension is greater than a frictional force f 1120 generated by the axial force F1 1118, the second compression spring 1114, and the first compression spring 1108 are compressed at the same time, the toothing is loosened, and the lifting table is raised and lowered. If the pulling force of the second compression spring 1114 is less than the frictional force f 1120, the gear shaper 1102 does not move in place, and the table top needs to be pressed down to rotate the gear plate counterclockwise, and a reverse force F2 1122 is added to loosen the gear shaper. When the lifting force is in balance with the desktop load, the gears can be easily released. The greater the lifting force is than the desktop load, the greater the reverse force F2 1122 is required to loosen the gears. This is the self-locking function of the slotted brake. When the brake cable is pulled by mistake, the desktop will not easily rise and fall, which plays a safety protection role.

Figure 13:
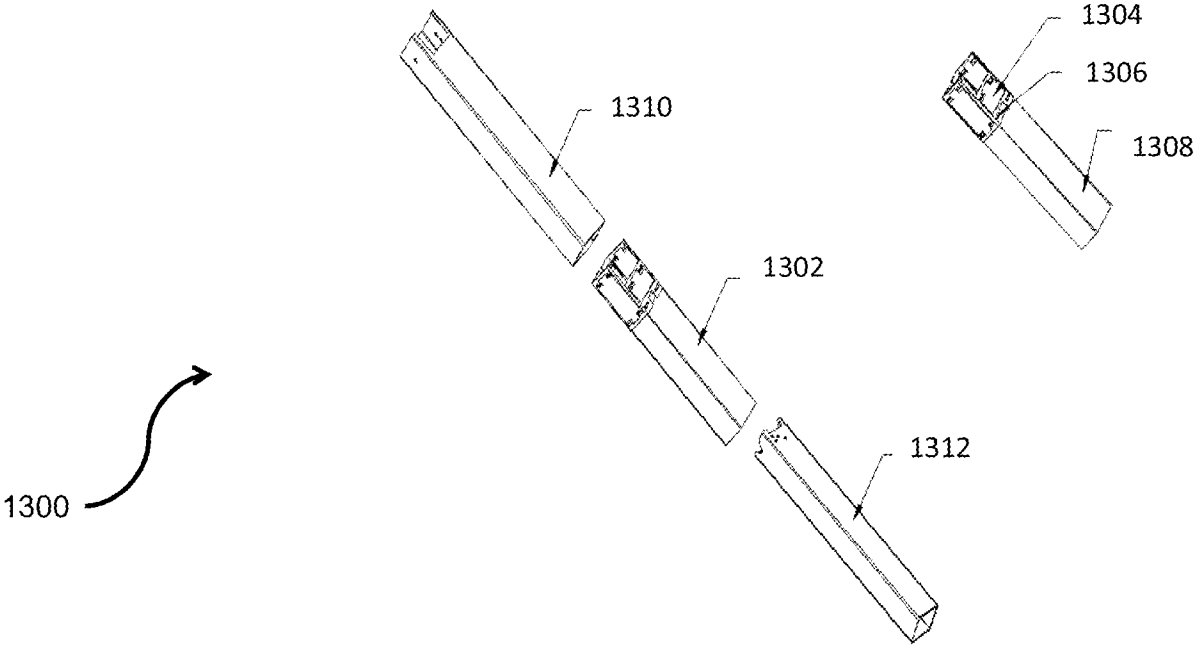
FIG. 13 illustrates a perspective view of a middle tube assembly, in accordance with an embodiment of the present invention.

FIG. 13 illustrates a perspective view 1300 of a middle tube assembly 1302 in accordance with an embodiment of the present invention. In an embodiment, the left table leg assembly 104 and the right table leg assembly 106 operate as a middle tube assembly 1302. The middle tube assembly 1302 is composed of roller frame 1304, roller 1306, and middle tube 1308. The middle tube assembly 1302 is installed between the outer tube 1310 and the inner tube 1312. Due to the rolling friction of the rollers 1306, the inner tubes 1312 and outer tubes 1310 can be telescoped and the lifting table can be raised and lowered.

Figure 14:
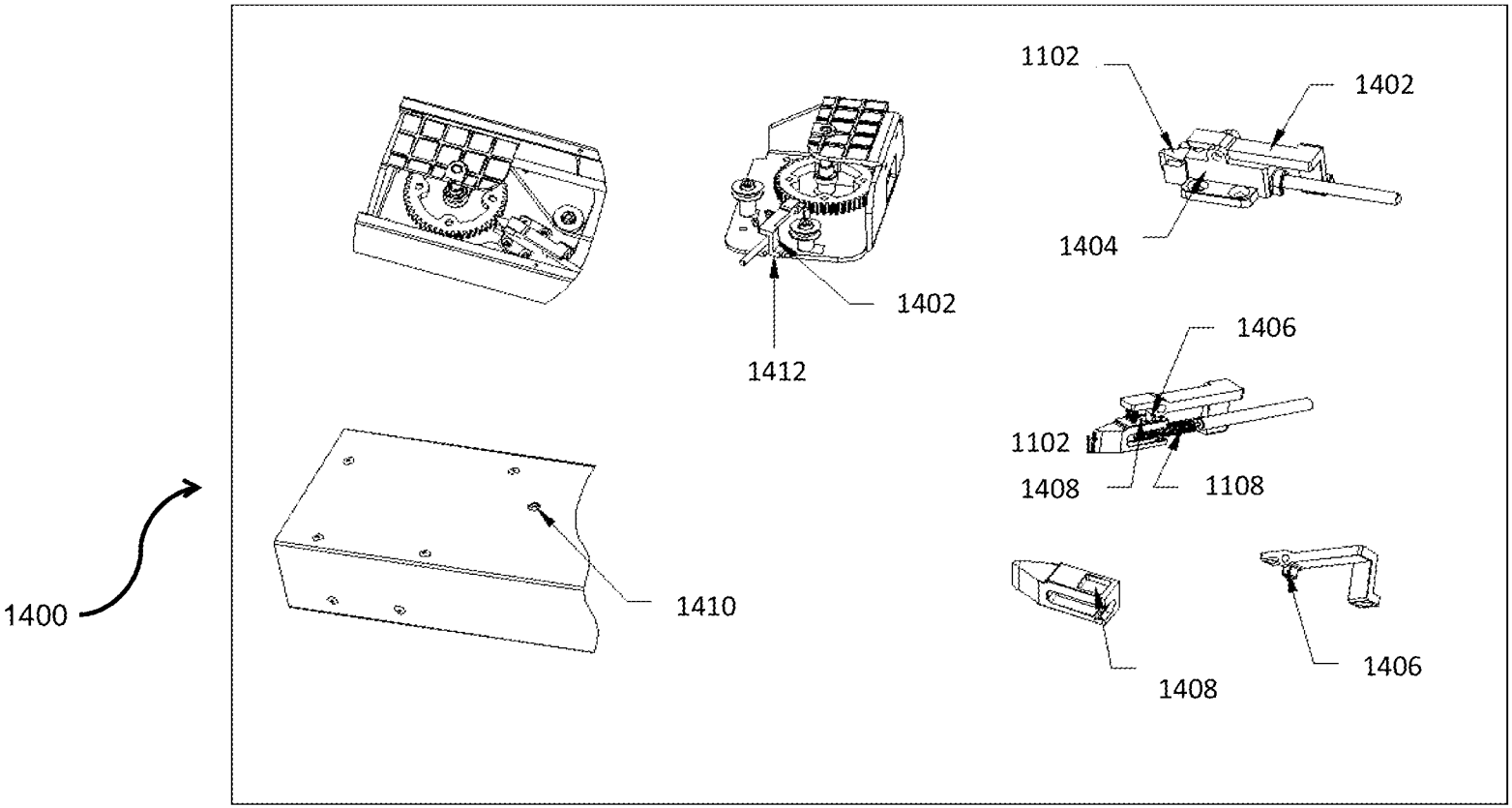
FIG. 14 illustrates a perspective view of a brake gear unlocking mechanism, in accordance with an embodiment of the present invention.

FIG. 14 illustrates a perspective view of a brake gear unlocking mechanism 1400, in accordance with an embodiment of the present invention. In an embodiment, the gear shaper assembly 906 is equipped with a brake gear unlocking mechanism 1400, which pushes the shift fork 1402 upward 1412 to unlock when the gear shaper 1102 cannot be separated from the gear. In an implementation, when the spring force is very different from the load force of the tabletop, the side of the gear shaper 1102 will receive increased lateral pressure from the gear. Pulling the brake wire will not cause the gear shaper 1102 to disengage and the table cannot be lifted. The brake gear unlocking mechanism of the present system solves this problem. In an embodiment, the brake gear shaper assembly is installed on an aluminum bracket, and the aluminum bracket is fixed on the beam. There is an operating hole at the bottom of the beam, which faces the end of fork 1402. Use a round rod with a diameter of 8 mm to push up the end of the shift fork to drive the tooth to retract from the gear to make the table work normally. The brake gear unlocking mechanism 1400 includes a seat 1404, an operating hole 1410, a groove 1408 of the gear shaper, a fork boss 1406.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A lifting table comprising a tabletop having a worksurface;

a support assembly connected to and supports the tabletop;

wherein the support assembly comprising a telescopic leg assembly comprising telescopically engaged telescopic members slidable relative to each other to adjust the table height;

a pulley assembly connected to the support assembly and is configured to adjust the table height; wherein the pulley assembly comprising a spool assembly, a wire rope assembly, and a drive spring assembly;

wherein the spool assembly comprising a spool, a brake gear, a gear shaper assembly;

wherein the wire rope assembly comprising an active wire rope assembly and an auxiliary wire rope assembly;

wherein the drive spring assembly comprising a drive spring;

wherein the spool is wound with the active wire rope assembly and the auxiliary wire rope assembly, coiled in opposite directions; wherein one end of the active wire rope assembly is wound onto the spool and the other end attached to the telescopic assembly; wherein the drive spring assembly is attached to the spool to power the spool and the wire rope assembly to adjust the height of the table;

wherein when the table is in position, the gear shaper assembly is meshed with the brake gear, the brake gear is locked in place to prevent the spool from rotation, the height of the table is fixed;

wherein upon pressing down on the table, the drive spring stretches, the spool rotates in a first direction, the active wire rope is unwound from the spool, the auxiliary wire rope is wound onto the spool, causing the telescopic members to slide towards each other to reduce the height of the table;

wherein upon raising the table, the drive spring retracts, the spool rotates in a second direction, the opposite of the first direction, the active wire rope is wound onto the spool, the auxiliary wire rope is unwound from the spool, causing the telescopic members to slide away from each other to increase the height of the table.

2. The table of claim 1, wherein the support assembly comprising a foot assembly.

3. The table of claim 1, wherein the table allows for continuous height adjustment of the table.

4. The table of claim 1, wherein the table allows for continuous on-demand follow-up stop when adjusting the height of the table.

5. The table of claim 1, wherein the table comprising a beam assembly that houses the pulley assembly; wherein the beam assembly is connected to the support assembly.

6. The table of claim 1, wherein the pulley assembly comprising a brake gear unlocking mechanism configured to unlock the brake gear to allow the spool to rotate to fix the height of the table.

7. The table of claim 6, wherein the brake gear unlocking mechanism comprising a brake rope assembly comprising a brake rope;

wherein pulling of the brake rope enables the gear shaper assembly to disengage from the brake gear to allow the spool to rotate to adjust the height of the table.

8. The table of claim 7, wherein the brake rope assembly comprising a compression spring sleeved over the brake rope.

9. The table of claim 7, wherein the brake rope assembly comprising a first compression spring and a second compression spring positioned on each side of a baffle plate, sleeved over the brake rope.

10. The table of claim 9, wherein when the brake rope is pulled, the second compression spring is pulled first, if the spring tension caused by the pulling force is greater than the frictional force between the brake gear and the gear shaper assembly, the second compression spring and the first compression spring are compressed at the same time to allow the gear shaper assembly to disengage from the brake gear to allow the spool to rotate to adjust the height of the table, if the pulling force of the brake rope is not enough to disengage the gear shaper assembly from the brake gear, pressing down on the tabletop rotates the brake gear in a second direction, opposition of the first direction, loosening the gear shaper assembly to allow the spool to rotate to adjust the height of the table.

11. The table of claim 6, wherein the brake gear locking mechanism comprising a shift fork, wherein when pushed upwards to allow the gear shaper to disengage from the brake gear to allow the spool to rotate to adjust the height of the table.

12. The table of claim 11, wherein shift fork comprising fork boss engageable with a groove on the gear shaper.

13. The table of claim 1,

Wherein the drive spring assembly comprising a drive spring tension regulator configured to adjusting the tension of the drive spring.

14. The table of claim 13,

Wherein the drive spring tension regulator comprising a gear box, a plurality of bevel gears, an adjusting screw and an adjusting shaft.

15. The table of claim 1, wherein the telescopic assembly comprising a left tube assembly and a right tube assembly, the left telescopic assembly comprising telescopically engaged left telescopic members, the right telescopic assembly comprising telescopically engaged right telescopic members.

16. The table of claim 15, wherein the active wire rope assembly comprising an active wire rope and a two-wire active wire rope;

wherein the active wire rope is connected to the spool on one end and to the two-wire active wire rope on the other end;

wherein the two-wire active wire rope comprising a left two-wire active wire rope and a right two-wire active wire rope;

wherein the left two-wire active wire rope is attached to the left tube assembly, the right two-wire active wire rope is attached to the right tube assembly;

wherein upon pressing down on the table, the drive spring stretches, the left two-wire active wire rope travels down along the left tube assembly, the left tube assembly contracts, the right two-wire active wire rope travels down along the right tube assembly, the right tube assembly contracts, the height of the table is reduced;

wherein upon raising the table, the drive spring retracts, the left two-wire active rope travels up along the left tube assembly, the left tube assembly extends, the right two-wire active wire rope travels up along the right tube assembly, the right tube assembly extends, the height of the table is increased.

17. The table of claim 15, wherein the left tube assembly comprising a left inner tube, a left middle tube, and a left outer tube; wherein the right tube assembly comprising a right inner tube, a right middle tube, and a right outer tube;

wherein the foot assembly comprising a left foot assembly connected to the left tube assembly, a right foot assembly connected to the right tube assembly.

18. The table of claim 1, wherein the auxiliary wire rope assembly comprising an auxiliary wire rope and a two-wire auxiliary wire rope;

wherein the auxiliary wire rope is connected to the spool on one end and to the two-wire auxiliary rope on the other end;

wherein the two-wire auxiliary wire rope comprising a left two-wire auxiliary wire rope and a right two-wire auxiliary wire rope.

19. The table of claim 1, wherein the telescopic assembly comprising an inner tube, a middle tube, and an outer tube;

wherein the middle tube comprising a roller.

20. The table of claim 1, comprising a self-locking mechanism, wherein the self-locking mechanism comprising a gear plate of the brake gear, a toothing of the gear shaper assembly, wherein when the lifting table is in position, the toothing of the gear shaper assembly is meshed with the gear plate of the brake gear, the pulling force of the drive spring generates an axial force F1 on the gear plate, causes the gear plate to rotate in a first direction, generate a frictional force f between the toothing and the gear plate and lock the brake gear;

wherein a reverse force F2 that causes the gear plate to rotate in a second direction, the reverse direction of the first direction, is needed to unlock the brake gear.

* * * * *